United States Patent [19]

Walker et al.

[11] 4,244,124

[45] Jan. 13, 1981

[54] STEAM IRON AND BAFFLING

[75] Inventors: Wendell C. Walker, Alta Loma; Arthur C. Downing, Ontario, both of Calif.

[73] Assignee: General Electric Company, New York, N.Y.

[21] Appl. No.: 94,978

[22] Filed: Nov. 16, 1979

[51] Int. Cl.[3] ..... D06F 75/06

[52] U.S. Cl. ..... 38/77.82; 38/77.83; 38/88

[58] Field of Search ..... 38/77.82, 77.83, 88

[56] References Cited

U.S. PATENT DOCUMENTS

| | | | |
|---|---|---|---|
| 3,497,975 | 3/1970 | Ledbetter | 38/77.82 |
| 3,747,241 | 7/1973 | Davidson | 38/77.83 |
| 3,872,613 | 3/1975 | Davidson et al. | 38/77.83 |
| 3,878,628 | 4/1975 | Gowdy | 38/77.82 |
| 4,086,714 | 5/1978 | Coggiola | 38/77.82 |
| 4,115,935 | 9/1978 | Toft | 38/88 |
| 4,130,954 | 12/1978 | Walker | 38/77.83 |

*Primary Examiner*—Louis Rimrodt

*Attorney, Agent, or Firm*—John F. Cullen; George R. Powers; Leonard J. Platt

[57] ABSTRACT

In a steam iron an improvement is provided comprising a separate molded plastic baffle that is inserted from the bottom of the tank into the riser portion, the baffle having a transverse vertical wall extending completely across the tank. To the vertical wall, an integral horizontal wall is cantilevered on one side to provide a stop by abutting the underside of the tank top when inserted from the bottom. A pair of vertical channels is offset from the vertical wall on the other side thereof and the channels extend into the riser portion being spaced to provide an opening for handle-mounted components including the dump rod, the channels being designed to direct water into the tank. A slanted and offset aperture in the vertical wall for guiding ribs around it, the aperture providing a supported guide for the low end of the rod.

5 Claims, 4 Drawing Figures

STEAM IRON AND BAFFLING

BACKGROUND OF THE INVENTION

1. Field of the Invention

The invention herein pertains to a plastic electric steam flatiron of the self-clean type and, more particularly, to a particularly formed plastic baffle in such an iron, the baffle performing multiple functions.

2. Description of the Prior Art

In irons that use water for steam or spray or both, a water tank is provided in the iron shell above the soleplate and under the handle portion and a valve drips water into a generator in the soleplate where it is flashed into steam and directed out ports in the soleplate to steam the article. Additionally, irons have incorporated other features such as self-clean and self-clean with surge as in U.S. Pat. Nos. 3,747,241 and 3,872,613 respectively both of common assignment. Also, plastic irons have emerged which, because of the versatility of molded plastic parts, have substantially simplified iron design by eliminating many common metallic parts. A typical plastic iron is shown in U.S. Pat. No. 4,115,935 illustrating a small lightweight iron and the same technology has now been extended to standard full size irons of the type shown in U.S. Pat. No. 4,130,954 both of common assignment. In ironing, when the iron is stopped at its forward stroke and, depending on the location of the fill opening, the water tends to keep moving and may be suddenly expelled out the fill opening. Also, when the iron is resting vertically on its heel trapped water may slosh out the fill opening. When the water in the tank boils its viscosity is greatly reduced and the water may be suddenly expelled out the fill opening and this is known as "upchucking". It is common to put baffling in steam iron water tanks to dampen or reduce surges due to momentum of the water and prevent "upchucking" during various ironing operations. A typical baffling arrangement is shown in U.S. Pat. No. 4,086,714 of common assignment. The present invention is directed to a steam flatiron with self-cleaning capabilities, the iron being plastic to include the water tank within and as part of the iron housing wherein a unique, easily assembled and inexpensive molded plastic baffling is provided to cooperate with the inner tank configuration, the baffling being easily inserted from below during assembly and being formed to direct water into the tank during filling and prevent water splashing from the fill opening and provide a firm support guide for the rod actuating the dump valve.

SUMMARY OF THE INVENTION

Briefly described, the invention is directed to an electric plastic steam iron with a controlled water valve and fill opening to an interior water tank molded as part of the plastic housing shell to form a riser portion extending into the connected handle. A ported soleplate with a steam generator and coverplate thereover is provided forming steam distribution passages. An iron purging or self-cleaning means includes a substantially large valved opening in the tank bottom with a button on the handle controlling a slanted rod to actuate the valve to dump the tank water onto the hot soleplate whereby a large quantity of steam is created to purge the iron. Such a structure is generally old and shown in U.S. Pat. No. 4,130,954 supra. To this general arrangement, the invention provides an improvement of a separate molded baffle for insertion through the tank bottom into the riser portion, the baffle having a transverse vertical wall extending across the tank to inhibit sloshing and having a horizontal wall cantilevered on one side of the vertical wall between its ends to form an upward limit stop against the tank top. A pair of vertical channels is supported by and offset from the vertical wall on the other side with the channels extending into the riser portion close to the fill opening to direct water to the tank. An opening is provided between the baffles for passage of handle-mounted components including the rod and a lower slanted aperture is disposed in the vertical wall to form a supported guide for the lower end of the rod. Thus, the main object of the invention is to disclose a plastic steam iron with a self-cleaning function and provide a single integral plastic particularly-formed baffling structure that can be used with a wide line of irons which single baffle has multiple functions by being easily assembled from below, directing fill water into the iron tank, preventing "upchucking" or water splashing from the fill opening, and providing a lower fixed support guide for the rod adjacent the dump valve.

DESCRIPTION OF THE PREFERRED EMBODIMENT

Figure 1:
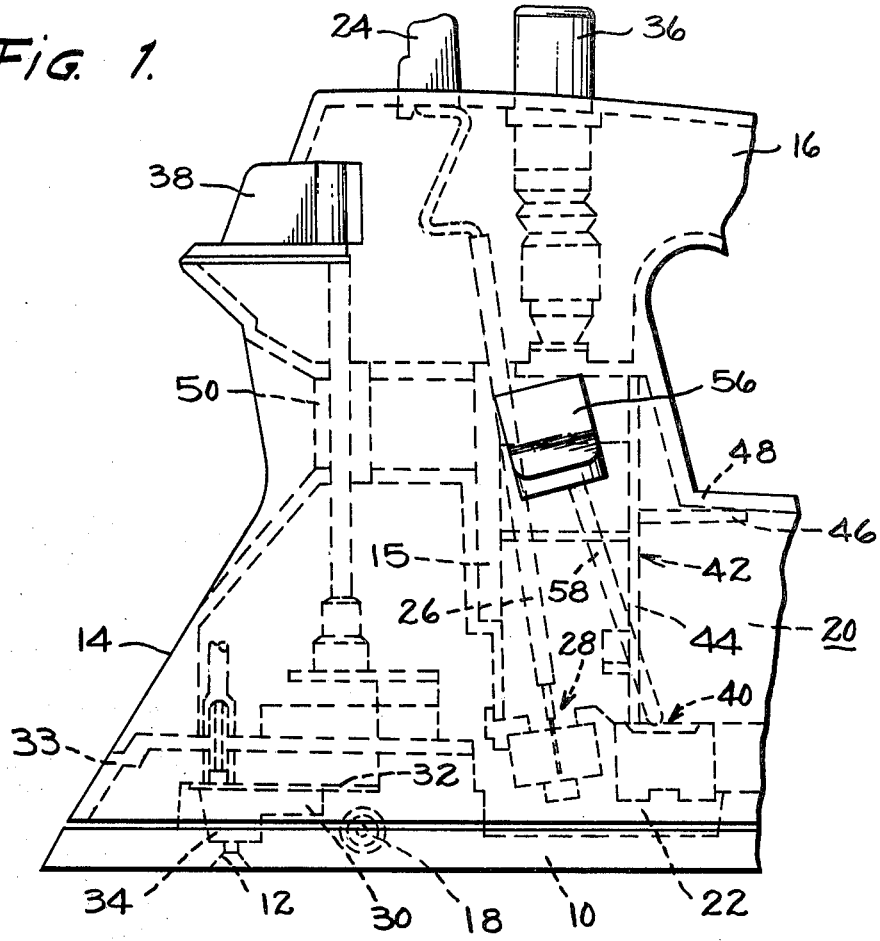
FIG. 1 is a partial elevational view showing the general parts of an iron including the baffle in dotted portions.

Referring to FIG. 1 there is shown an electric steam iron generally of the self-cleaning variety of the type shown in U.S. Pat. No. 3,747,241 supra. As such, the iron includes a soleplate 10 with a plurality of steam ports 12 and an outer plastic shell 14 with a forward or higher riser portion 15 which, with shell 14, is connected to extend into handle 16 in known fashion. Soleplate 10 conveniently may be cast from aluminum with an electric heating element 18 cast in position and disposed so uniform heat distribution is provided when the iron is plugged in and activated.

The iron includes means for generating steam by providing water tank 20 that is an inner part of single plastic housing shell 14 secured to soleplate 10 in a known manner. For steam, soleplate 10 has a steam generator 22 into which, under control of button 24 and guided valve stem 26 movable between an on/off position, water controllably drips from tank 20 onto hot soleplate 10 through metering water valve 28 of the type in U.S. Pat. No. 3,496,661 of common assignment, the resulting steam being distributed through passages 30 under coverplate 32 and out ports 12 onto the fabric being ironed. In the embodiment shown, an additional surge is provided by injecting water into a separate forward generator 34 by control button 36. A temperature control 38 thermostatically controls the soleplate heat and all the structure described is generally well known. One of the main features in the self-cleaning iron is provision for suddenly and completely dumping tank 20 onto the hot soleplate through a substantially large opening that preferably, although not necessarily, is spaced and separate from the usual water valve 28.

Controlling this large opening, a dumper valve generally indicated at 40 and disposed in the bottom of the water tank, operates to quickly empty the tank onto the soleplate where the combination of hot water and steam suddenly created forcefully steams out and purges or cleans the internal passages, the tank, and the ports 12 of lint and internal deposits. A valve structure for the dump valve is shown in U.S. Pat. No. 4,130,954 supra.

Previous forms of baffling included metallic plates extending across usually separate metallic tanks to inhibit sloshing and dampen surges as shown at 48 and 50 respectively in U.S. Pat. No. 3,878,628 of common assignment. In the normal ironing operation, a figure eight, or side, or uneven ironing motion, causes the water in the tank to slosh and be expelled out the fill opening during jerking movements and especially when suddenly upended on its heel rest position. Since the water is hot, it is necessary to prevent this expelling or "upchucking". Normal internal sloshing is reduced by conventional separate internal baffling to dampen surges of the tank water as is well known.

With the advent of the molded-in water tank being part of the actual shell housing of the iron, and using fewer parts, a single integral baffle to perform all the necessary functions and still further reduce the number of parts, is desired.

Figure 2:
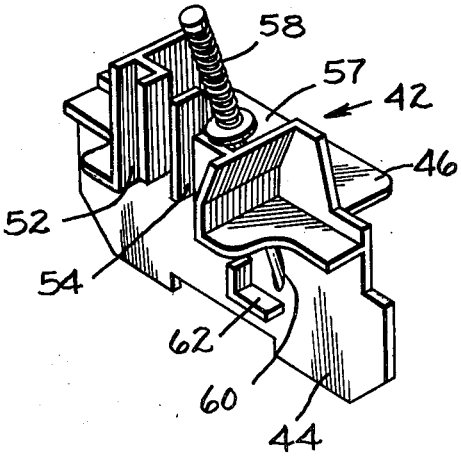
FIG. 2 is a perspective of the baffle with the dump valve slanted rod in position.
Figure 3:
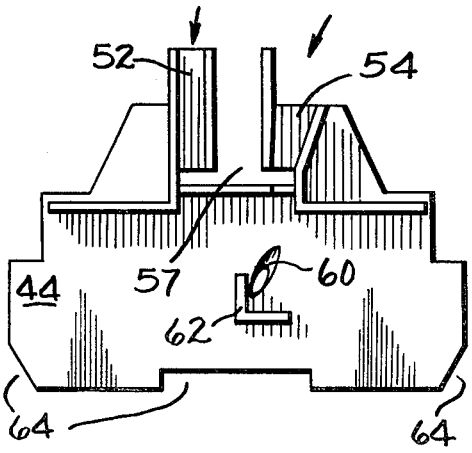
FIG. 3 is an elevational view of the baffle showing the support and guiding structure for the rod and, FIG. 4 is a perspective, partially broken away, of an iron with the baffle in position.
Figure 4:
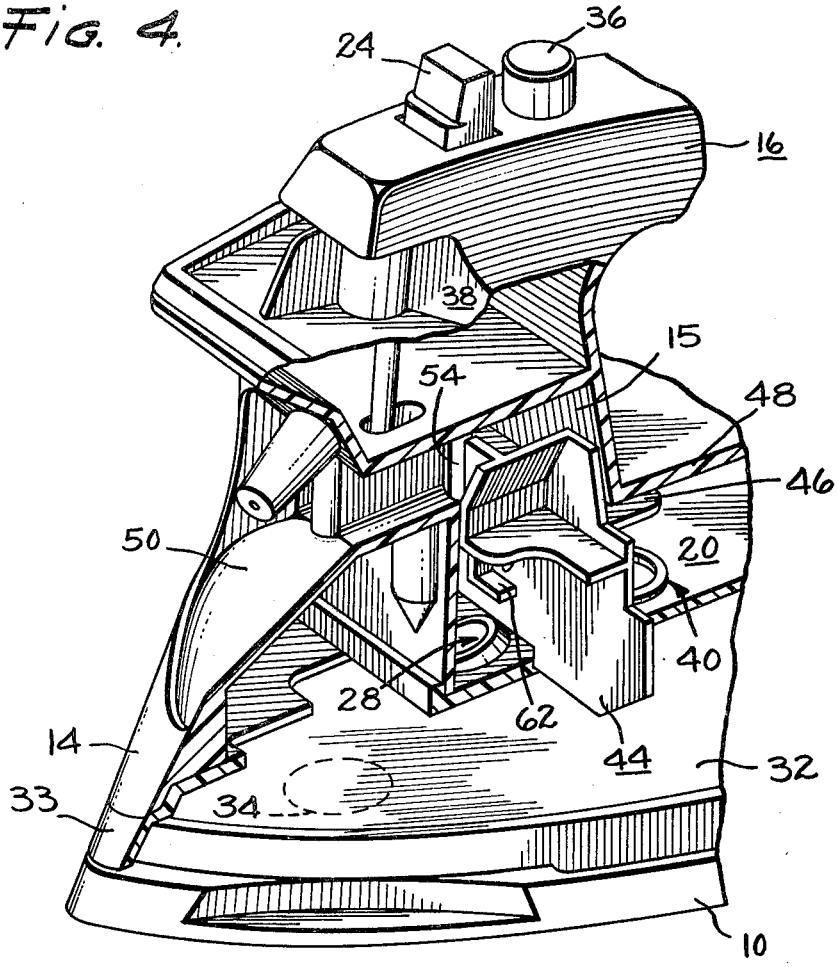

To this end, and in accordance with the invention, a separate one-piece molded plastic baffle 42 (FIG. 2) is provided and designed to be inserted from the bottom of the housing 14 before attachment of the skirt 33. This is a single plastic structure that has a main transverse or vertical wall 44 to extend completely across the width of tank 20 much as any other baffle. To provide a stop or locating component within the tank, a shelf or horizontal wall 46 is cantilevered on one side of the vertical wall 44 between its extreme ends and is disposed to abut the upper inner wall of the tank at 48 forming a limit stop on the tank. In other words, the baffle is inserted from the bottom up into the riser portion 15 until horizontal wall 46 abuts the tank at 48. To direct water through fill opening 50 into the front portion of the handle and down into tank 20, the baffle is provided with a pair of vertical channels 52 and 54 which are spaced apart from each other to provide an opening 57 therebetween. The channels are offset from vertical wall 44 towards the forward portion of the iron on the other side of wall 44 from horizontal wall 46 as clearly seen in FIG. 2. The channels extend into the riser portion 15 adjacent the fill opening 50 to catch and direct the water down into the tank through the conduit formed by the channel and internal front wall of the tank or as indicated by the arrows in FIG. 3. The nonsymmetry of the channels is due to internal structural requirements of molded housing 14.

Because internal components comprise the linkage structure connecting steam button 24 to water valve 28, some of the structure connected with surge button 36, and an external handle mounted button 56 that is spring biased to press down on slanted rod 58, the space between the channels is intended to accommodate some of these components such as rod 58 which opens dump valve 40 when actuated by dump button 56 as fully described in the U.S. Pat. No. 4,130,954. The bottom of the slanted rod 58 must be firmly guided and supported and, to this end, a slanted aperture 60 is provided in the vertical wall 44, the aperture being offset from the vertical centerline to accommodate the offset of rod 58 due to the side handle mounting of the rod and button 56. The rod 58 then extends through the aperture 60 for guiding and close support of the lower end of the rod adjacent dumper valve 40.

Because the rod is inserted from above after much of the iron has been assembled, it is desireable to make sure the lower end of the rod is aligned through aperture 60, and to this end, guiding and reinforcing molded ribs 62 are provided adjacent the aperture and direct the rod during assembly. These ribs also reinforce wall 44 at the aperture 60. Thus, the rod is easily inserted from above and firmly supported in aperture 60 by the offset slanted location of the aperture and rod insertion may easily be done from above after the iron has been almost completely assembled. In accordance with the usual baffle structure, the vertical wall 44 has plural wall flow openings 64 through which water may pass in order to dampen the surges.

It will be seen that the single molded plastic baffle 42, by its formation and shape, is easily assembled from below during assembly of the iron by merely pushing it up into the tank until horizontal wall 46 abuts the inner surface of the tank at 48 to firmly and solidly locate the baffle. The channels 52 and 54 direct the fill water into the tank around wall 44 by the openings 64. The wall 44 prevents surging and "unchucking" out the fill hole, and the guided aperture 60 provides a firm support and guide for the lower end of the rod 58 adjacent the dump valve. The baffle provides a further simplification of the internals of the plastic iron whereby the baffle 42 eliminates some prior parts and performs multiple functions.

While there has been described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

We claim:

1. In a plastic steam iron having a controlled water valve and fill opening to an interior water tank molded in a plastic shell to have a riser portion extending into a connected handle, a ported soleplate with a steam generator and cover thereover forming steam distribution passages, and iron purging means including a substantially large valved opening in the tank bottom with handle means controlling a slanted rod actuating the opening valve to dump the tank water onto the soleplate, the improvement comprising, a separate molded baffle for bottom tank insertion into the riser portion, and having a transverse vertical wall extending across the tank, a horizontal wall cantilevered on one side of said vertical wall between its ends at the tank top forming an upward limit stop on the tank, a pair of vertical channels offset from said vertical wall on the other side thereof, said channels extending into said riser portion adjacent the fill opening directing water to the tank, and aperture means in said vertical wall forming a supported guide for the lower end of said rod, whereby a single molded plastic baffle is easily assembled from below, directs water into and prevents water splashing from the fill opening and provides a support guide for the rod adjacent the dump valve.

2. Apparatus as described in claim 1 wherein said pair of channels are spaced to provide an opening therebetween for passage of handle-mounted components including said rod.

3. Apparatus as described in claim 2 wherein said aperture through the vertical wall is slanted and offset from the vertical centerline thereof to guide said slanted rod.

4. Apparatus as described in claim 2 wherein molded integral directed ribs are disposed on the vertical wall adjacent the aperture for reinforcement and guide means for firm rod support and easy assembly respectively of said rod after the tank is assembled.

5. Apparatus as described in claim 4 wherein said vertical wall has plural wall flow openings therethrough for damping surging in said tank.

* * * * *